US007805777B2

(12) United States Patent
Hughes

(10) Patent No.: US 7,805,777 B2
(45) Date of Patent: Oct. 5, 2010

(54) CLOSET FLANGE SPACER

(75) Inventor: Alan Hughes, Wayne, NJ (US)

(73) Assignee: Set-Rite Products, LLC, Wayne, NJ (US)

( * ) Notice: Subject to any disclaimer, the term of this patent is extended or adjusted under 35 U.S.C. 154(b) by 668 days.

(21) Appl. No.: 11/269,022

(22) Filed: Nov. 8, 2005

(65) Prior Publication Data

US 2006/0213003 A1 Sep. 28, 2006

Related U.S. Application Data

(60) Provisional application No. 60/665,905, filed on Mar. 28, 2005.

(51) Int. Cl.
*E03D 11/16* (2006.01)

(52) U.S. Cl. ..... 4/252.4; 4/252.1; 33/562; 33/645

(58) Field of Classification Search ..... 4/252.1, 4/252.4, 252.6, 252.5; 285/56; 33/528, 562, 33/566, 645

See application file for complete search history.

(56) References Cited

U.S. PATENT DOCUMENTS

| | | | | |
|---|---|---|---|---|
| 2,673,985 | A | 4/1954 | Gay | |
| 2,908,513 | A | 10/1959 | Karlinski | |
| 3,311,391 | A * | 3/1967 | Harrell | 4/252.5 X |
| 3,896,510 | A | 7/1975 | O'Connell | |
| 4,384,910 | A | 5/1983 | Prodyma | |
| 4,515,398 | A | 5/1985 | Machon, Sr. | |
| 5,018,224 | A | 5/1991 | Hodges | |
| 5,190,320 | A | 3/1993 | Hodges | |
| 5,232,250 | A | 8/1993 | Bonacci | |
| 5,432,957 | A | 7/1995 | Fernie et al. | |
| 5,996,134 | A | 12/1999 | Senninger | |
| 6,065,160 | A | 5/2000 | Winn | |
| 6,223,356 | B1 | 5/2001 | Corbin | |
| 6,416,084 | B1 * | 7/2002 | Mantyla | 285/56 |
| 6,443,495 | B1 | 9/2002 | Harmeling | |
| 6,581,214 | B1 | 6/2003 | Love et al. | |
| 6,634,034 | B2 * | 10/2003 | Rendell | 4/252.4 |
| 6,751,812 | B2 | 6/2004 | Malloy | |

OTHER PUBLICATIONS

Flier for J-tec Products Company,"Closet Flange Extension", undated, 1 page.

Web page, http://jtecprod.com/products2.html, untitled document, dated Mar. 12, 2005, 1 page.

(Continued)

*Primary Examiner*—Robert M Fetsuga
(74) *Attorney, Agent, or Firm*—Hoffmann & Baron, LLP

(57) ABSTRACT

In one aspect of the subject invention, a spacer is provided for supporting a closet flange above a sub-flooring, the closet flange having a pipe section and an annular flange extending radially outwardly from the pipe section. The spacer includes a disc-shaped body having spaced apart first and second faces, and spaced apart inner and outer edges extending between the first and second faces. The inner edge defines an opening extending through the body, the opening sized to permit passage therethrough of the pipe section of the closet flange but not the annular flange of the closet flange. The outer edge is generally smooth and arcuate. Advantageously, with the subject invention, a spacer is provided usable with a closet flange to provide elevation thereof.

8 Claims, 4 Drawing Sheets

OTHER PUBLICATIONS

Quik-Fix, "closet ring extenders, flange support kit, metal ring replacement flange, Quik Fix, Span-A-B . . . " http://www.quickfixplumbingproducts.com/, dated Mar. 23, 2005, 3 pages.

Quik-Fix, "closet flange extender brochure", http://www.quickfixplumbingproducts.com/extbroch.htm, dated Mar. 23, 2005, 1 page.

Web page, http://www.bluehipdistributor.com/catalog/i203.html, "New! Sioux Chief Stainless Steel Push-Tile Gasketed Toilet Flange", Mar. 23, 2005, 1 page.

Web page, http://www.wantasub.com/bayflange.html, "Toilet Flange", Mar. 23, 2005, 1 page.

* cited by examiner

CLOSET FLANGE SPACER

CROSS-REFERENCE TO RELATED APPLICATION

This application claims priority to U.S. Provisional Patent Application No. 60/665,905, filed Mar. 28, 2005, the contents of which are incorporated by reference herein.

BACKGROUND OF THE INVENTION

This invention relates to closet flange supports acting between a sub-flooring and a closet flange.

During new building construction or renovation, the installation of a toilet and finished flooring about the toilet have to be coordinated. Particularly, the toilet rests above or upon the finished flooring and is fastened to a closet flange, which, in turn, is fastened to a soil pipe. The toilet includes an exit hole which is placed atop the closet flange with a wax seal sealing the connection to prevent any leakage. Waste flushed from the toilet flows through the closet flange and into the soil pipe, ultimately reaching a sewer or other septic system.

With new building construction or renovation, a closet flange is typically installed prior to installation of finished flooring. To do so, a hole is made through the sub-flooring at a desired location for a toilet. The hole is sized to accommodate a closet flange. There are, then, several options in the prior art to install a closet flange through the hole in the sub-flooring. In one option, a closet flange is directly fastened to the sub-flooring, and a finished flooring is installed about the closet flange. With the closet flange fixed to the sub-flooring, however, the finished flooring extends above the closet flange, thus not permitting a direct connection between a toilet and the closet flange. To allow for a proper sealed connection, closet flange extenders have been developed in the prior art to increase the height of the closet flange to that of the finished flooring, such as described in U.S. Pat. No. 4,384,910 to Prodyma, and U.S. Pat. No. 5,018,224 to Hodges. As can be appreciated by those skilled in the art, the closet flange extenders are in contact with any fluid flow from the toilet bowl and provide undesired additional leakage points.

To avoid closet flange extenders, closet flanges have been installed with spacers to elevate the closet flanges above the sub-flooring. Typically, materials available at a building site have been used as the spacers to elevate a closet flange. For example, pieces of copper tubing or wood have been wedged between a closet flange and a sub-flooring to elevate the closet flange. Ideally, the spacers allow finished flooring to be installed flush below the closet flange, thereby allowing a toilet to rest on the finished flooring and be directly connected to the closet flange without any closet flange extenders. However, the scrap material spacers often either do not provide sufficient elevation to accommodate the thickness of the finished flooring, thus not permitting a finished flooring to fit between the closet flange and the sub-flooring, or provide an elevation greater than the thickness of the finished flooring, thereby elevating the closet flange more than desired (the toilet may not rest flush on the finished flooring). In either scenario, undesired adjustment of the closet flange height is required.

The problem of coordinating a finished closet flange height and finished flooring has been recognized in the prior art and several solutions have been proposed. For example, U.S. Pat. No. 6,065,160 to Winn proposes a threaded closet flange which may have its height adjusted by rotation. U.S. Pat. No. 6,751,812 to Malloy proposes a closet flange having a thickened flange portion which coincides with the thickness of a finished floor. The Malloy closet flange is a unitary piece. U.S. Pat. No. 6,443,495 to Harmeling proposes a closet flange having elevation structures located thereabout to provide spacing between the sub-flooring and the closet flange. As with the Malloy closet flange, the Harmeling closet flange is also a unitary structure. U.S. Pat. No. 5,996,134 to Senninger proposes the use of a spacer equivalent to the height of a poured concrete sub-flooring to raise the closet flange above the sub-flooring.

U.S. Pat. No. 6,581,214 to Love et al. discloses a spacer and shim assembly for raising a closet flange. Stackable spacers of equal thickness are provided. The spacers are stacked to achieve a required thickness and are provided with detents to prevent rotation therebetween. Once stacked, the spacers have tabs which are fastened to a sub-flooring, and a closet flange is fixed to the spacers, not to the sub-flooring.

SUMMARY OF THE INVENTION

In one aspect of the subject invention, a spacer is provided for supporting a closet flange above a sub-flooring, the closet flange having a pipe section and an annular flange extending radially outwardly from the pipe section. The spacer includes a disc-shaped body having spaced apart first and second faces, and spaced apart inner and outer edges extending between the first and second faces. The inner edge defines an opening extending through the body, the opening sized to permit passage therethrough of the pipe section of the closet flange but not the annular flange of the closet flange. The outer edge is generally smooth and arcuate. Advantageously, with the subject invention, a spacer is provided usable with a closet flange to provide elevation thereof.

These and other features of the invention will be better understood through a study of the following detailed description and accompanying drawings.

SUMMARY OF THE INVENTION

Figure 1:
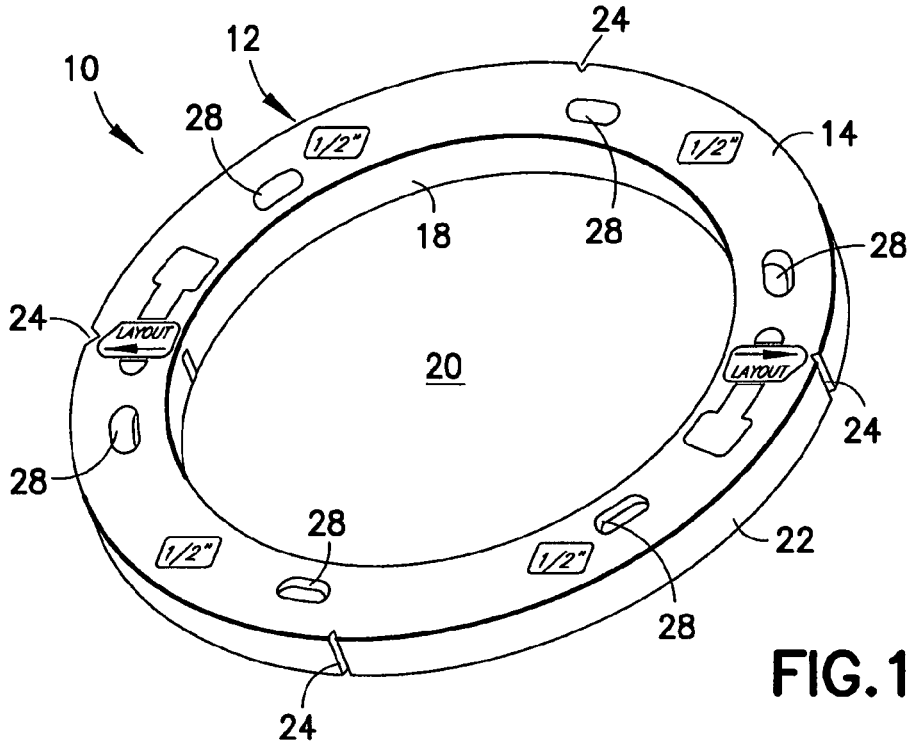
FIG. 1 is a perspective view of a spacer formed in accordance with the subject invention.

With reference to the figures, a spacer 10 is provided for supporting a closet flange above a sub-flooring. The spacer 10 includes a body 12, which is preferably disc-shaped. The body 12 includes opposed first and second faces 14 and 16, which are both preferably flat. In addition, the body 12 includes an inner edge 18, defining an opening 20 through the body 12, and an outer edge 22. Preferably, the body 10 has an annular shape with the inner and/or outer edges 18, 22 being circular. The outer edge 22 is preferably smooth, without any protrusions extending therefrom, and arcuate.

As shown in the figures, it is preferred that the body 12 be unitary. The body 12 may be formed from any material, preferably, a polymeric material. The body 12 may be formed from plastic, which is well-suited to be molded (e.g., injection molded). The body 12 may also be colored (e.g., uniformly colored). For example, the body 12 may be colored white or red. With coloring, the body 12 may be made visually easy to spot. Also, the body 12 may be colored to be readily distinguished from other building materials, particularly piping. Where standard polyvinyl chloride (PVC) piping, which is white, is being used, the body 12 may be colored red, and where standard acrylonitrile butadiene styrene (ABS) piping, which is black, is being used, the body 12 may be made white and/or red.

Figure 4:
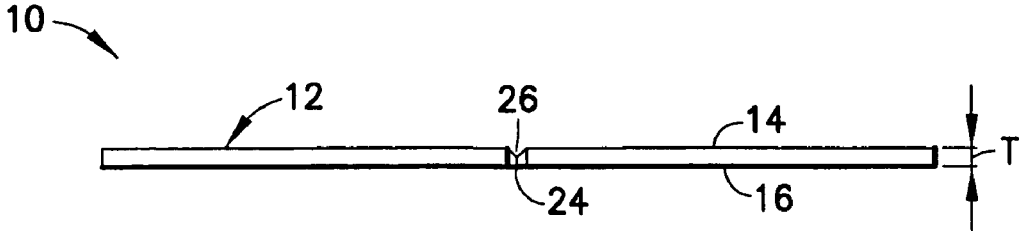
FIG. 4 is a side elevational view of a spacer.
Figure 5A:
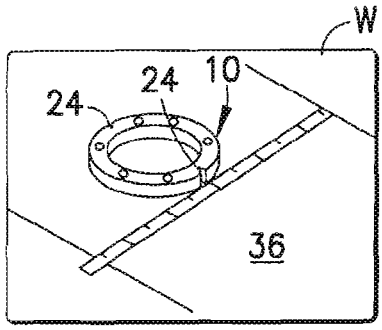
FIGS. 5(*a*)-(*d*) show an illustrative manner of installing a spacer.
Figure 5B:
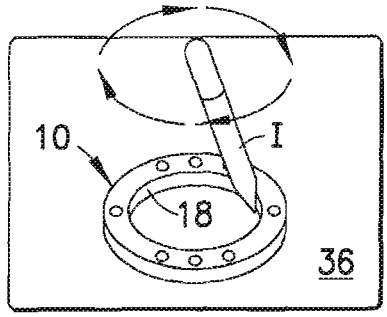
Figure 5C:
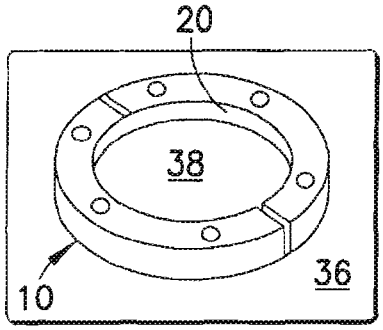
Figure 5D:
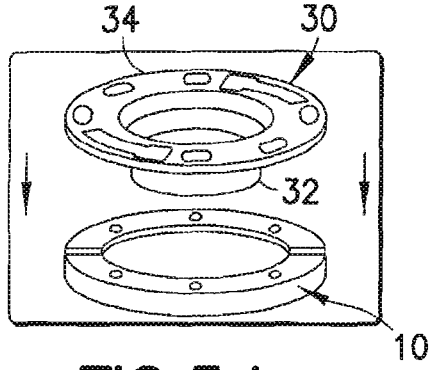

Specifically, and with reference to FIG. 4, it is preferred that the first and second faces 14 and 16 be generally parallel. The body 12 may be formed with a generally constant thickness T between the first and second faces 14 and 16. The thickness T may be generally 0.125 inches, 0.25 inches, 0.5 inches, or 0.75 inches.

Figure 2:
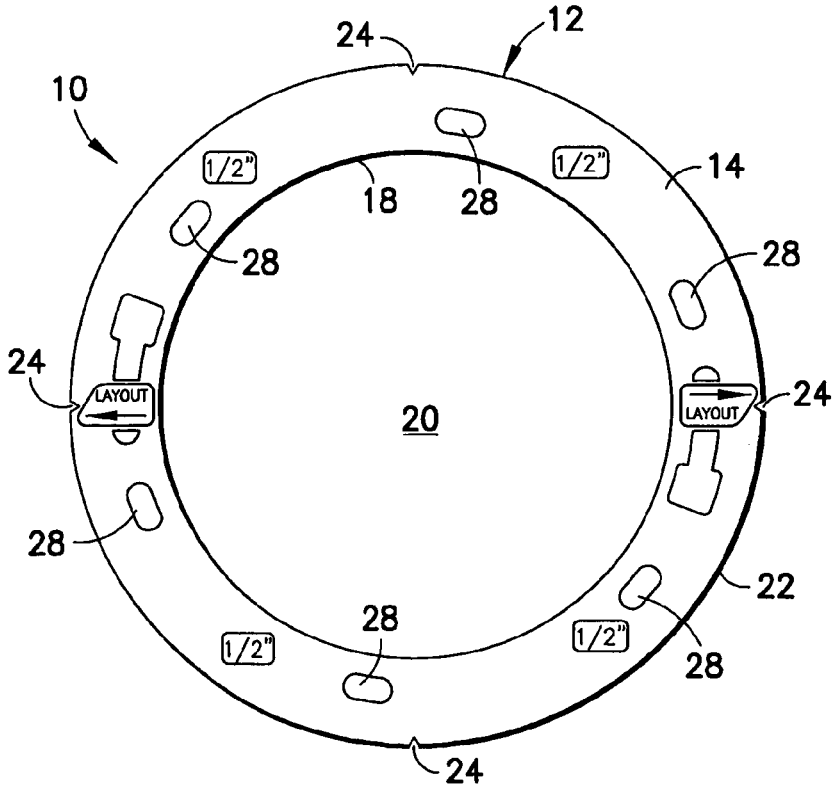
FIG. 2 is a top plan view of a spacer.
Figure 3:
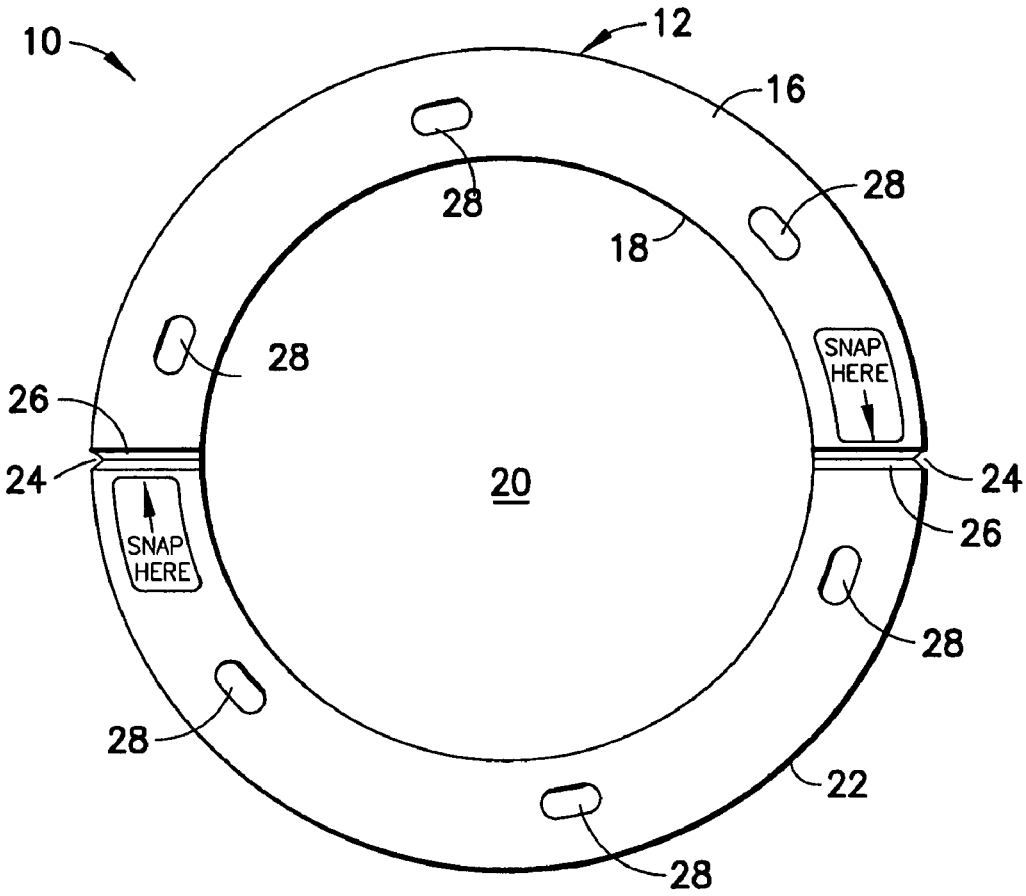
FIG. 3 is a rear plan view of a spacer.

The spacer 10 may be optionally provided with additional features. As shown in FIG. 2, at least one notch 24, preferably at least two of the notches 24, are provided in the outer edge 22. The notches 24, as discussed below, are usable to measure and locate the proper location of the spacer 10 at an installation. It is preferred that two of the notches 24 be located along a straight axis intersecting a center of the body 12 (e.g., a line coinciding with a diameter of the body 12). For convenience, and as shown in the figures, four of the notches 24 may be provided, with the notches 24 forming two pairs, each pair being disposed along a straight axis intersecting a center of the body 12. The two defined axes are preferably generally perpendicular (e.g., the four notches are located substantially 90° apart along the outer edge 24).

The spacer 10 may also be provided with at least one score line 26 which defines a reduced-thickness portion in the body 12 between the first and second faces 14 and 16 (FIG. 4). It is preferred that at least two of the score lines 26 be provided and aligned to coincide along a straight axis intersecting a center of the body 12. With this arrangement, the score lines 26 provide a line of weakness in the body 12 which can be broken resulting in the spacer 10 being broken into two generally-equal parts. As described below, the breaking of the spacer 10 into two parts may aide in its installation. To enhance the weakness of the score lines 26, the notches 24 may be aligned with the score lines 26, as best shown in FIG. 4.

One or more fastener holes 28 may be formed in the body 12 to extend through and between the first and second faces 14 and 16. Preferably, six of the fastener holes 28 are provided, with three of the fastener holes 28 being located on each side of the score lines 26. The fastener holes 28 are circumferentially spaced apart and preferably are elongated slots to allow for radial adjustment of the body 12 relative to any fastener(s) passing therethrough. The fastener holes 28 are sized to accommodate typical fastener diameters, e.g., typical screw diameters.

With reference to FIGS. 5(*a*)-(*d*) and 6, an illustrative method of installing the spacer 10 is depicted. The spacer 10 is used to support a closet flange 30 which includes a pipe section 32 and an annular flange 34 extending radially outwardly from the pipe section 32.

Prior to installation of finished flooring, and after preparation of a sub-flooring 36, a hole 38 is required to allow for passage of the pipe section 32 through the sub-flooring 36. As is well known in the art, the closet flange 30, and thus the hole 38, must be located a predetermined distance from a wall to allow for proper toilet installation. With reference to FIG. 5(*a*), the hole 38 preferably is layed out by locating at least one of the notches 24 a predetermined distance from a relevant wall W. To ensure proper location, it is preferred that two of the notches 24 (which are located along an axis intersecting a center of the body 12) be located the predetermined distance from the wall W. With two of the notches 24 being located the predetermined distance from the wall W, the notches 24 define an axis generally parallel to the wall W at the predetermined distance. Once the predetermined distance is set, and as shown in FIG. 5(*b*), the inner edge 18 of the spacer 10 is traced by a writing or marking instrument I to provide an outline for the hole 38. The spacer 10 is removed and the hole 38 is formed by cutting through the sub-flooring 36 along the outline.

The spacer 10 is then placed on the sub-flooring 36 with the opening 20 generally coinciding with the hole 38, as shown in FIG. 5(*c*). It is desired that both the opening 20 and the hole 38 be sized to permit passage therethrough of the pipe section 32 of the closet flange 30 but not permit passage of the annular flange 34.

Depending on the thickness of the finished flooring, one or more of the spacers 10 can be stacked about the hole 38. By using multiple spacers 10, particularly of varying thicknesses T, stacks of various thicknesses can be achieved.

Figure 6:
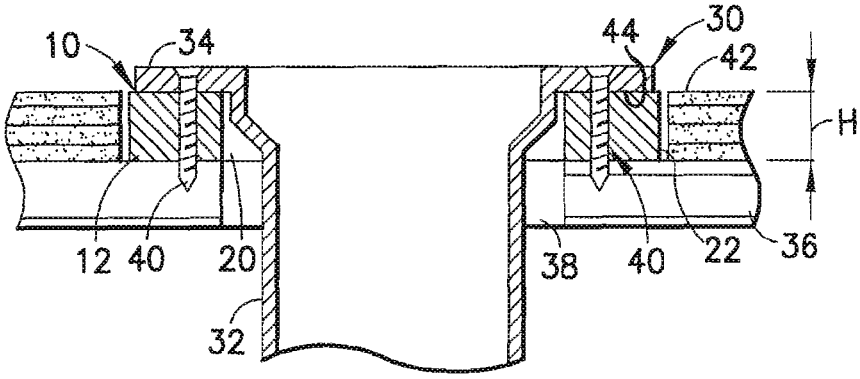
FIG. 6 is a schematic cross-section of an installed spacer.

Once the spacer(s) 10 have been set about the hole 38, the pipe section 32 of the closet flange 30 is inserted through the opening 20 and through the hole 38 (FIG. 5(*d*)) until the annular flange 34 comes to rest on top of the spacer(s) 10 (FIG. 6). It is preferred that the body 12 be sized slightly larger than the diameter of the annular flange 34 to ensure a full resting surface is provided. It is further preferred that the outer edge 22 protrude radially 0.125 inches beyond the annular flange 34 on all sides.

The entire spacer(s) 10/closet flange 30 assembly is then fastened to sub-flooring 36 using fasteners 40. The fasteners 40 preferably pass through the annular flange 34, the body 12, and into the sub-flooring 36. Any known fasteners 40 may be used (e.g., screws, nails, rivets, etc.) and the fasteners 40 may be passed through the fastener holes 28 to limit stresses on the body 12.

Once fastened, a finished flooring 42 may be installed about the spacer(s) 10/closet flange 30, as shown in FIG. 6. The finished flooring 42 may be of any known materials, including tiles, boards, poured concrete, and so forth. Where the finished flooring 42 is being poured, the spacer(s) 10 advantageously seal the hole 38 from the poured material.

Figure 7:
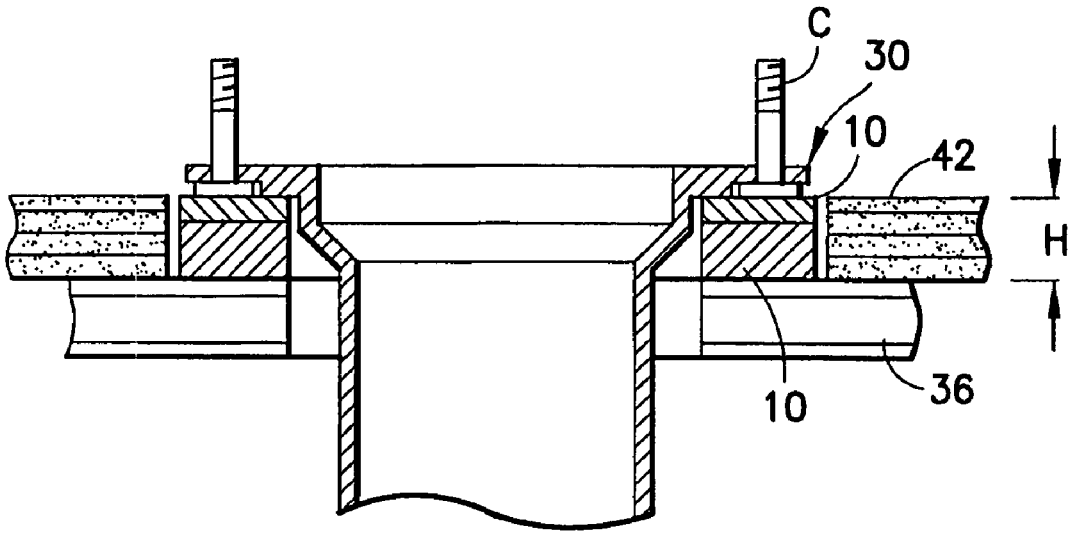
FIG. 7 is a schematic cross-section of a stack of installed spacers.

It is preferred that the thickness of the spacer(s) 10 generally equal the height H of the finished flooring 42. In this manner, lower face 44 of the closet flange 30 will be generally flush with the top of the finished flooring 42. As shown in FIG. 7, closet flange bolts C may be attached to the closet flange 30 as known in the art. The closet flange bolts C rest on the uppermost spacer 10. With this arrangement, a toilet may rest flush on the finished flooring 42 and be directly connected to the closet flange 30 without extenders or other devices.

It is preferred that the thickness T of the spacer 10 generally equal the height H of the finished flooring 40. In this manner, only one of the spacers 10 is required. To allow for mixing and matching of various thicknesses, two or more of the spacers 10 having different thicknesses T may be used as shown in FIG. 7. Advantageously, two or more of the spacers 10, having different thicknesses T, can be sold as a kit to accommodate different heights H of the finished flooring 42. The stacked spacers 10 may be rotated freely relative to each other, particularly where the spacers 10 have interengaging flat first and/or second faces 14, 16. For example, the fastener holes 28 of the stacked spacers 10 may be aligned by rotating the stacked spacers 10.

Figure 8:
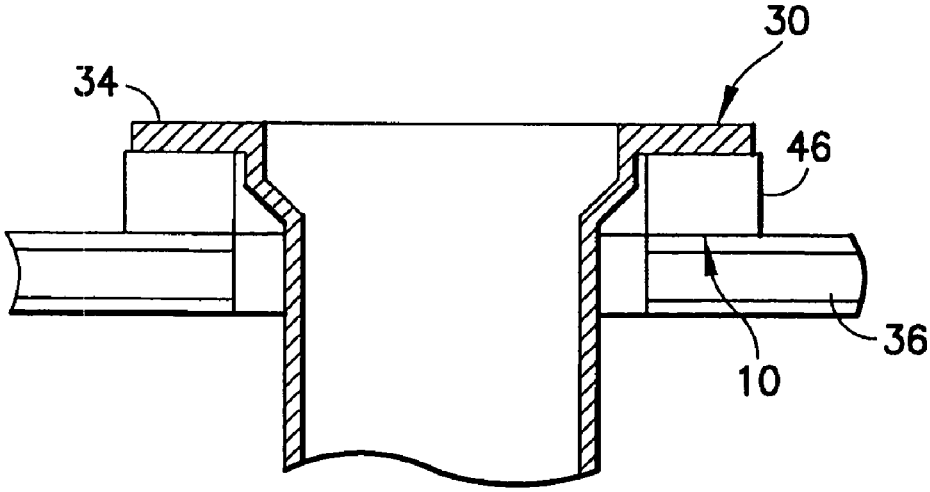
FIG. 8 is a schematic cross-section of a part of an installed spacer.

Installation of the spacer 10 may be aided by breaking the spacer 10 along the score lines 26. For example, with the spacer 10 being broken apart, the spacer 10 may be placed about a pre-installed closet flange 30. As shown in FIG. 8, a first part 46 of the spacer 10 is inserted between the annular flange 34 and the sub-flooring 36, to be followed by a second part of the spacer 10 (not shown). As indicated above, it is preferred that the spacer 10 break into two generally equal parts, but it may be broken into any number of parts which permit it to function properly. The parts 46 of the spacer 10 are then fastened as described above.

What is claimed is:

1. A method of installing a closet flange substantially flush to a later-installed finished flooring utilizing a spacer, the finished flooring to be installed atop a sub-flooring, the closet flange having a pipe section and an annular flange extending radially outwardly from said pipe section, said flange having a lower face, the spacer having spaced apart, generally flat first and second faces, and spaced apart inner and outer edges extending between said first and second faces, said inner edge defining an opening which permits passage therethrough of said pipe section of said closet flange but not said flange of said closet flange, said spacer generally having the same thickness as the thickness of the finished flooring, wherein first and second notches being formed in said outer edge, said first and second notches being disposed along a straight axis intersecting a center of the spacer, said method comprising:

locating said spacer on the sub-flooring with said first and second notches being located the same distance from an adjacent wall;

after locating said spacer on the sub-flooring with said first and second notches being located the same distance from an adjacent wall, tracing said inner edge of said spacer on said sub-flooring to define an outline;

preparing a hole in the sub-flooring along said outline which permits passage therethrough of said pipe section of said closet flange but not said flange of said closet flange;

disposing said spacer onto the sub-flooring about said hole;

inserting said pipe section of said closet flange through said opening in said spacer and into said hole in the sub-flooring; and, fastening said flange of said closet flange to said sub-flooring, with said flange of said closet flange resting in face-to-face engagement on said first face of said spacer and with said lower face of said flange being positioned to be generally flush with the later-installed finished flooring.

2. A method as in claim 1, wherein said fastening of said closet flange includes passing a fastener through said flange, through said body of said spacer, and into the sub-flooring.

3. A method as in claim 1, wherein at least one fastener hole is formed to extend through said body of said spacer.

4. A method as in claim 1, wherein said body of said spacer defines a thickness, said thickness being selected from the group consisting of 0.125 inches, 0.25 inches, 0.5 inches and 0.75 inches.

5. A method of installing a closet flange substantially flush to a later-installed finished flooring utilizing at least first and second spacers, the finished flooring to be installed atop a sub-flooring, the closet flange having a pipe section and an annular flange extending radially outwardly from said pipe section, said flange having a lower face, the at least first and second spacers each having spaced apart, generally flat first and second faces, and spaced apart inner and outer edges extending between said first and second faces, said inner edge defining an opening which permits passage therethrough of said pipe section of said closet flange but not said flange of said closet flange, wherein at least said first spacer includes first and second notches formed in said outer edge, said first and second notches being disposed along a straight axis intersecting a center of the first spacer, said method comprising:

locating said first spacer on the sub-flooring with said first and second notches being located the same distance from an adjacent wall;

after locating said first spacer on the sub-flooring with said first and second notches being located the same distance from an adjacent wall, tracing said inner edge of said first spacer on said sub-flooring to define an outline;

preparing a hole in the sub-flooring along said outline which permits passage therethrough of said pipe section of said closet flange but not said flange of said closet flange;

disposing at least said first and second spacers onto the sub-flooring about said hole in stacked arrangement, said spacers in said stacked arrangement generally having the same thickness as the thickness of the finished flooring;

inserting said pipe section of said closet flange through said openings in said spacers and into said hole in the sub-flooring; and, fastening said flange of said closet flange to said sub-flooring with said flange of said closet flange resting in face-to-face engagement on the first face of the uppermost spacer of said spacers in said stacked arrangement and with said lower face of said flange being positioned to be generally flush with the later-installed finished flooring.

6. A method as in claim 5, wherein said fastening of said closet flange includes passing a fastener through said flange, through said body of each said spacer, and into the sub-flooring.

7. A method as in claim 5, wherein at least one fastener hole is formed to extend through said body of each said spacer.

8. A method as in claim 5, wherein said body of each said spacer defines a thickness, said thickness being selected from the group consisting of 0.125 inches, 0.25 inches, 0.5 inches and 0.75 inches.

* * * * *